United States Patent [19]

Hushbeck

[11] 4,311,197

[45] Jan. 19, 1982

[54] ANNULUS PRESSURE OPERATED CLOSURE VALVE WITH IMPROVED REVERSE CIRCULATION VALVE

[75] Inventor: Donald F. Hushbeck, Duncan, Okla.

[73] Assignee: Halliburton Services, Duncan, Okla.

[21] Appl. No.: 112,199

[22] Filed: Jan. 15, 1980

[51] Int. Cl.[3] ..... C21B 34/08

[52] U.S. Cl. ..... 166/373; 166/317; 166/321; 166/332; 137/68 R; 251/58

[58] Field of Search ..... 166/321-335, 166/319, 317, 316, 264, 162, 169, 167, 168, 165, 315; 285/3, 4; 251/58; 137/68 R; 267/180

[56] References Cited

U.S. PATENT DOCUMENTS

| | | | |
|---|---|---|---|
| 3,130,789 | 4/1964 | Alexander et al. | 166/317 |
| 3,388,745 | 6/1968 | Cole | 166/317 |
| 3,970,147 | 7/1976 | Jessup et al. | 166/323 |
| 4,063,593 | 12/1977 | Jessup | 166/321 |
| 4,064,937 | 12/1977 | Barrington | 166/162 |

*Primary Examiner*—William F. Pate, III

*Attorney, Agent, or Firm*—John H. Tregoning; James R. Duzan; Lucian Wayne Beavers

[57] ABSTRACT

A testing apparatus for use in an oil well includes an improved circulation valve having a cylindrical housing with an open bore therethrough and a circulating port through a wall thereof. A valve mandrel is slidably received in the housing and movable from a closed position closing said circulating portion to an open position opening said circulating port. A shear pin is provided between the valve mandrel and the cylindrical housing and initially retains the valve mandrel in its closed position. The valve mandrel is arranged and constructed for engagement with a power mandrel of the testing apparatus upon movement of the power mandrel in a first direction so that said valve mandrel is forced in said first direction by engagement with said power mandrel and said shear pin is sheared to release the valve mandrel from its closed position. A biasing spring is provided for aiding movement of the valve mandrel to its open position upon shearing of the shear pin. An improved drain valve is also provided for such a testing apparatus.

26 Claims, 15 Drawing Figures

ANNULUS PRESSURE OPERATED CLOSURE VALVE WITH IMPROVED REVERSE CIRCULATION VALVE

Figure 1:
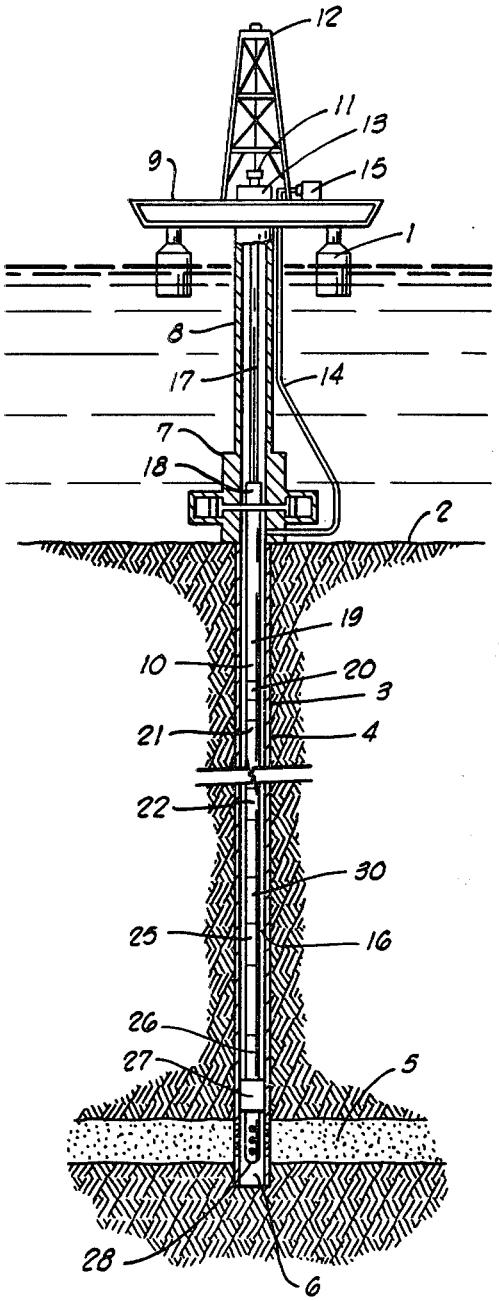

This invention relates generally to an apparatus for testing an oil well, and more particularly, but not by way of limitation to a reverse circulation valve for use with a full opening closure valve operating in response to annulus pressure.

The present invention is an improved version of an annulus pressure operated closure valve with reverse circulation valve disclosed in U.S. Pat. No. 4,064,937 to Barrington, assigned to the assignee of the present invention.

U.S. Pat. No. 4,064,937 discloses a closure valve for use in oil well testing which provides a full opening flow passage therethrough, and which includes a reverse circulation valve. The closure valve is operated by a power mandrel which is responsive to well annulus pressure and which is frangibly held in the open position until a predetermined pressure is applied to the fluid in the well annulus. The power mandrel is then frangibly released and moves the closure valve to the closed position. The power mandrel is then disconnected from the closure valve operating mechanism and continues to move to activate a circulation valve opening mechanism. The closure valve includes two normally open ball valves which are spaced apart to trap a sample of formation fluid therebetween when the ball valves are closed.

The circulation valve of the apparatus disclosed in U.S. Pat. No. 4,064,937 is arranged and constructed so that a sliding valve mandrel is movable from a normally closed position closing a circulating port, to a normally open position opening said circulating port. Attached to the valve mandrel are a plurality of spring fingers which are initially held against a ledge of a housing by close engagement with the power mandrel. After movement of the power mandrel upward through a predetermined distance, the heads of the spring fingers are allowed to contract into a reduced diameter part of the power mandrel, thereby releasing the valve mandrel and allowing it to be moved downward to its open position. That downward movement is accomplished by expansion of a coil compression spring.

A problem encountered with the apparatus of U.S. Pat. No. 4,064,937 is with the difficulty of assembly and maintenance due to the spring finger type holding means used to initially hold the circulation valve in its closed position. This design has been completely changed by the present invention so that the valve mandrel is initially held in place by a shear pin which is sheared by impact of the power mandrel upon the valve mandrel.

Other prior art references relate generally to annulus pressure responsive valves for use in testing oil wells. U.S. Pat. No. 3,850,250 and U.S. Pat. No. 3,930,540, both to Holden, et al, and assigned to the assignee of the present invention, disclose a circulation valve which opens after a predetermined number of annulus pressure changes have been applied to the well annulus.

U.S. Pat. No. 3,823,773 to Nutter, discloses a circulation valve which is an integral part of a sampler mechanism wherein the sampler mechanism opens and closes responsive to pressure changes in the well annulus. The circulation valve disclosed therein moves from a closed position to an open position after a predetermined number of operations of the sampler valve.

U.S. Pat. No. 3,970,147 to Jessup, et al, and assigned to the assignee of the present invention, discloses a circulation valve which moves to a locked open position responsive to an increase in annulus pressure above a given value. One embodiment shows a circulation valve which is an integral part of a sliding sleeve type normally open tester valve, arranged such that the tester valve closes prior to the opening of the circulation valve.

A dual CIP reverse circulating valve offered by Halliburton Services of Duncan, Oklahoma, is a reverse circulating valve in which spring loaded fingers hold a sliding sleeve mandrel in a position covering reverse circulating ports in a housing of the valve. The sleeve mandrel is spring loaded toward the open position. The dual CIP reverse circulating valve is operated by a drill pipe rotation wherein rotation advances an operating mandrel which also opens and closes a tester valve mechanism. After a predetermined number of rotations, the tester valve is closed and additional rotation activates a releasing mechanism which releases the mechanism holding the sliding sleeve valve mandrel. The sliding sleeve mandrel is then moved to the open position by the mentioned spring, thereby uncovering the circulating ports to allow reverse circulation.

U.S. Pat. No. 3,856,085 to Holden, et al, and assigned to the assignee of the present invention, discloses an annulus pressure operated well testing apparatus which includes a full opening ball valve for providing a fully opened passageway through the testing string to the formation to be tested.

The improved circulation valve of the present invention has a cylindrical housing with an open bore therethrough and a circulating port through a wall thereof. A valve mandrel is slidably received in the housing and movable from a closed position closing said circulating port upwards to an open position opening said circulating port. A shear pin is provided between the valve mandrel and the cylindrical housing and initially retains the valve mandrel in its closed position. The valve mandrel is arranged and constructed for impacting engagement with a power mandrel upon movement of the power mandrel in a first direction, so that said valve mandrel is forced in said first direction by engagement with said power mandrel and said shear pin is sheared to release the valve mandrel from its closed position. A biasing spring is provided for aiding movement of the valve mandrel to its open position upon shearing of the shear pin.

An improved drain valve for these types of testing tools is also provided by the present invention.

The circulation valve of the present invention may be utilized with an annulus pressure operated closure valve having a power mandrel and power mandrel restraining means such as that disclosed in U.S. Pat. No. 4,064,937. The power mandrel and power mandrel restraining means disclosed herein, however, are identical to that disclosed in a U.S. Pat. No. application filed on the same date as the present application by Burches Q. Barrington and assigned to the assignee of the present invention, and claimed therein as the invention of Burches Q. Barrington.

Numerous features and advantages of the present invention will be apparent to those skilled in the art upon a reading of the following detailed description in combination with the accompanying drawings.

FIG. 1 is a schematic elevation view of a typical well testing apparatus using the present invention.

FIGS. 2A-2F comprise a right side only cross sectional view of the present invention with the closure valve in the open position and the circulation valve in the closed position.

Figure 3:
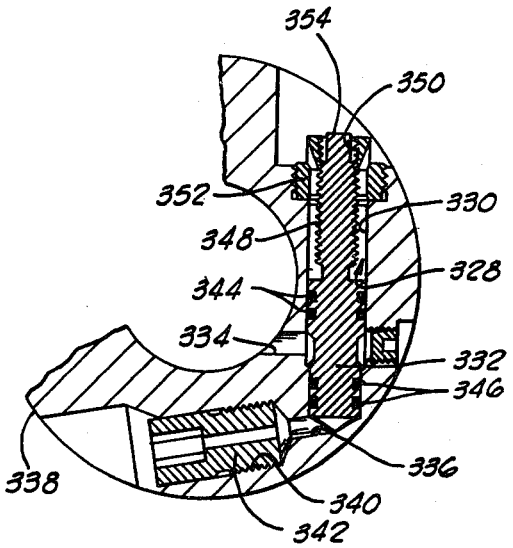
Figure 2A:
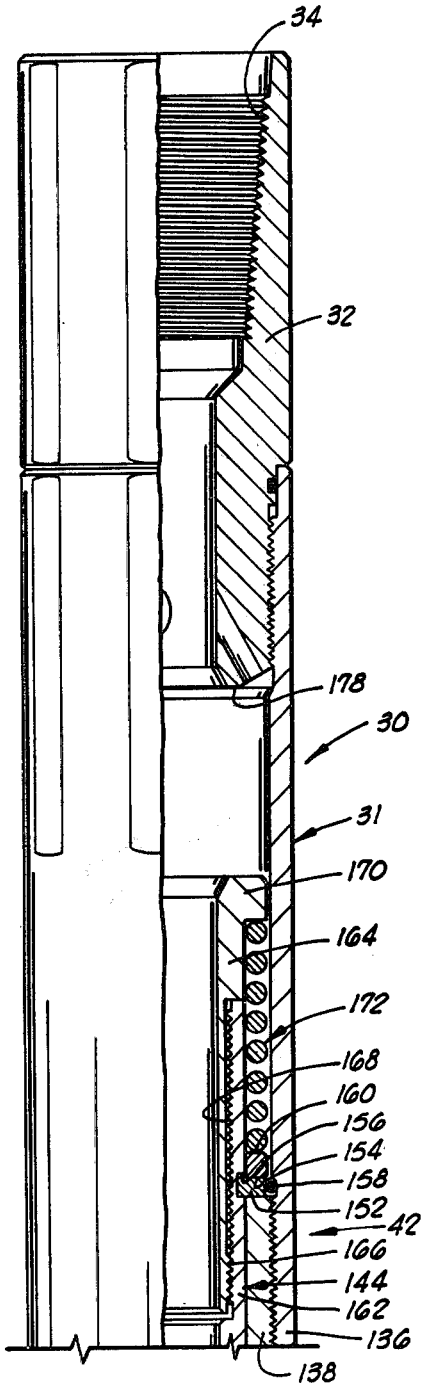
Figure 2B:
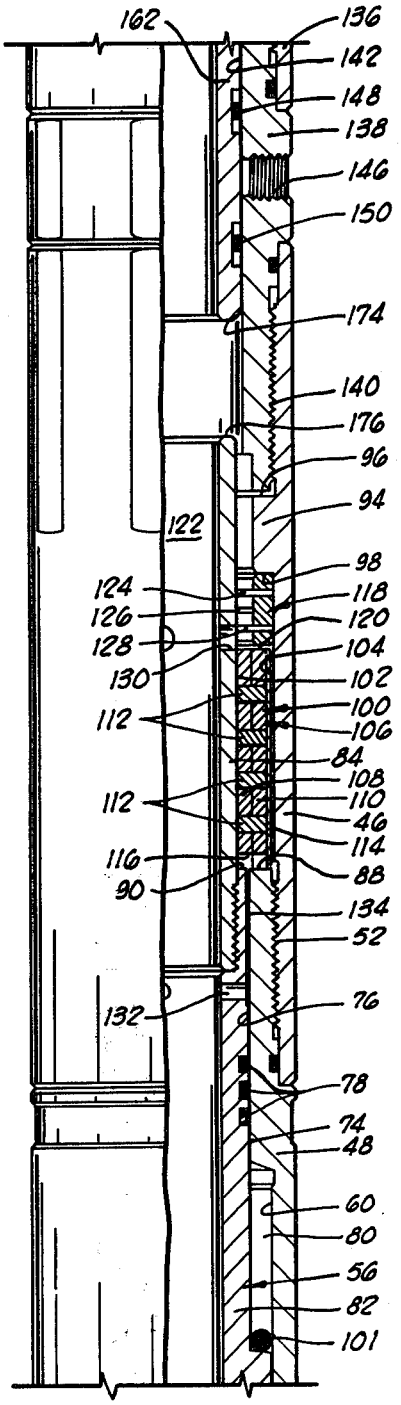
Figure 2C:
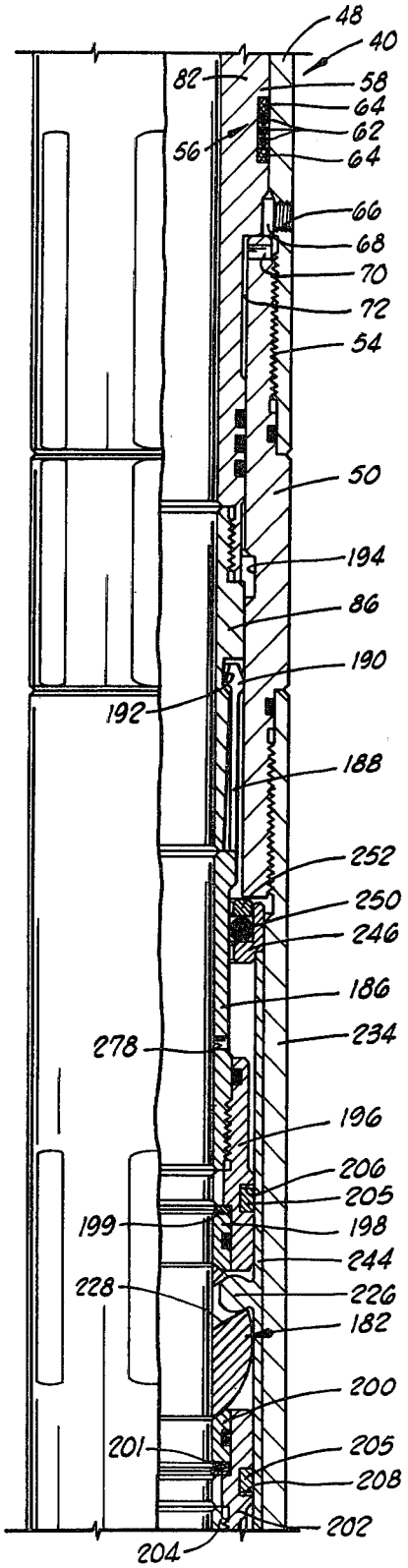
Figure 2D:
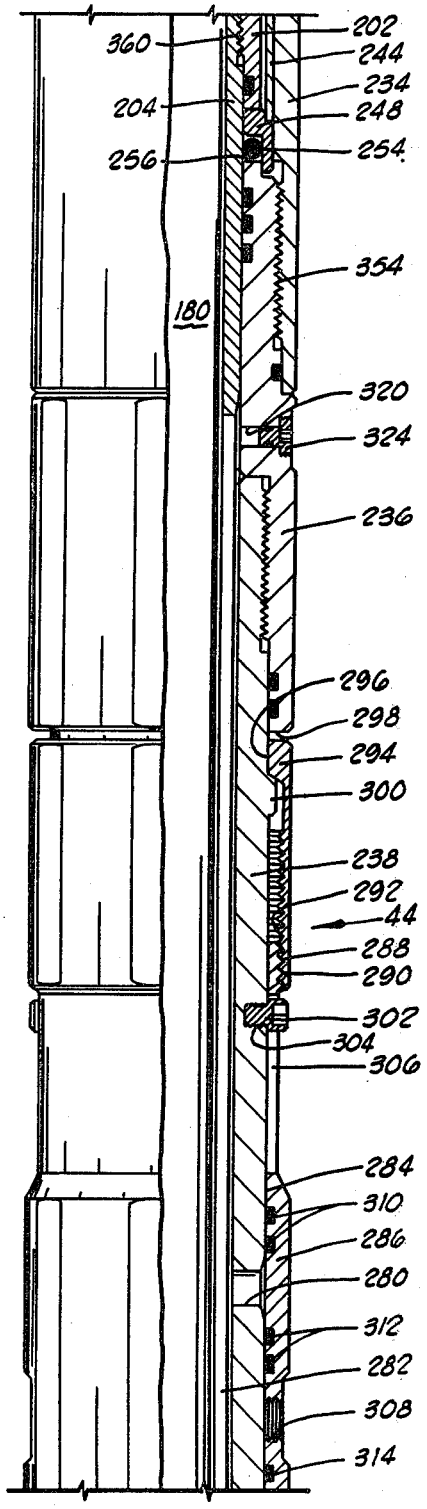
Figure 2E:
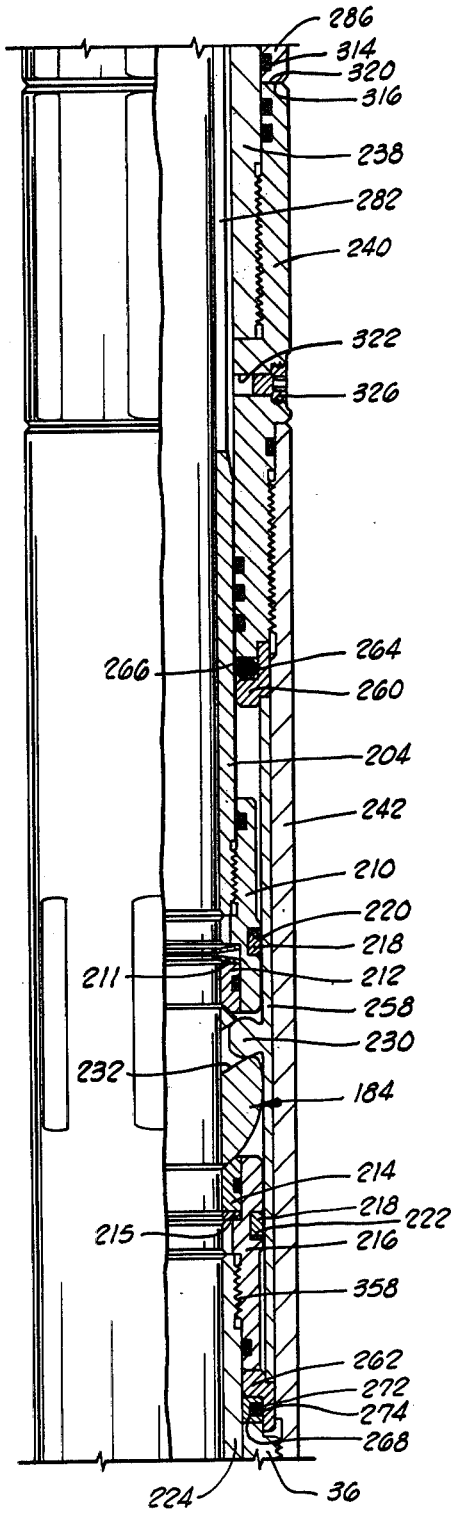
Figure 2F:
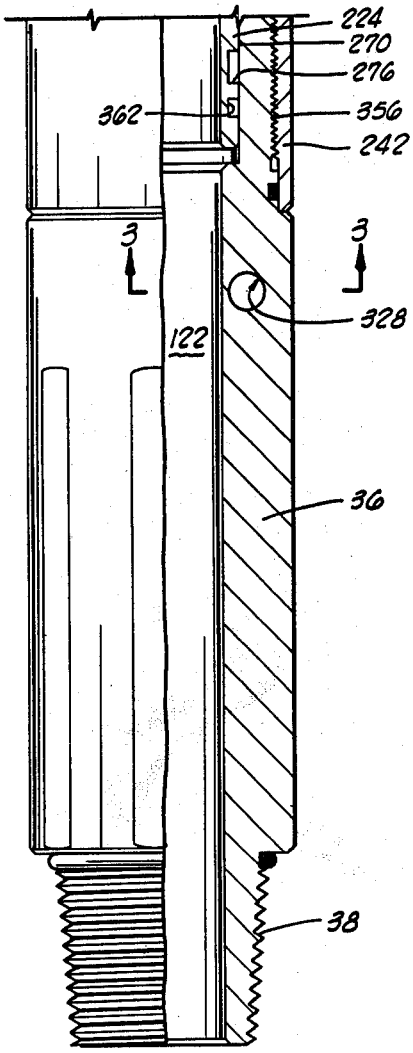

FIG. 3 is a cross sectional view taken about line 3—3 of FIG. 2F showing the drain valve below the sample chamber.

FIGS. 4A-4H comprise a right side only cross sectional view of an alternative embodiment of the present invention with the closure valve in the open position and the circulation valve in the closed position.

Figure 4A:
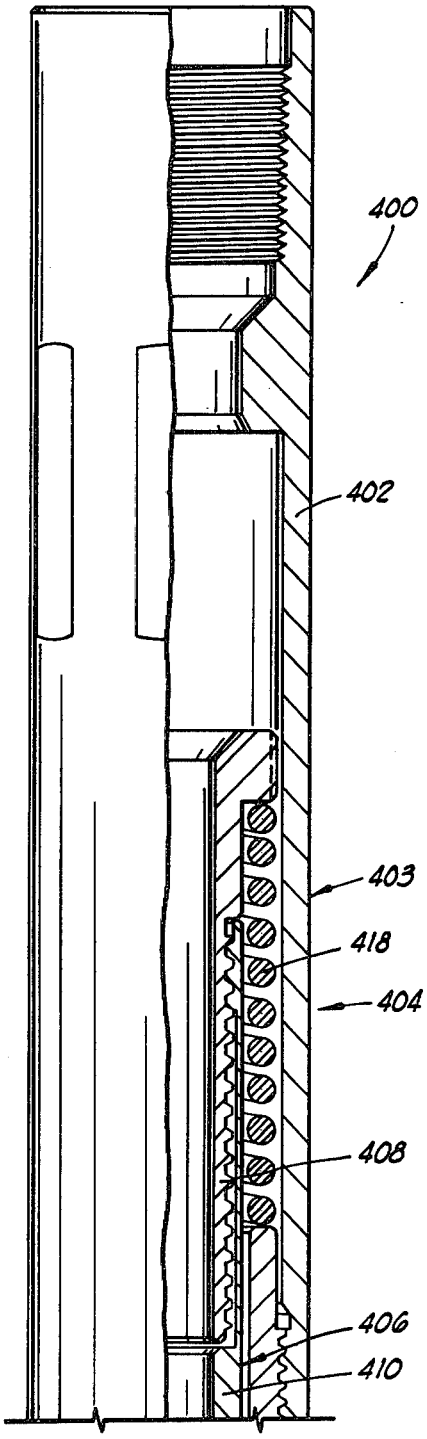
Figure 4B:
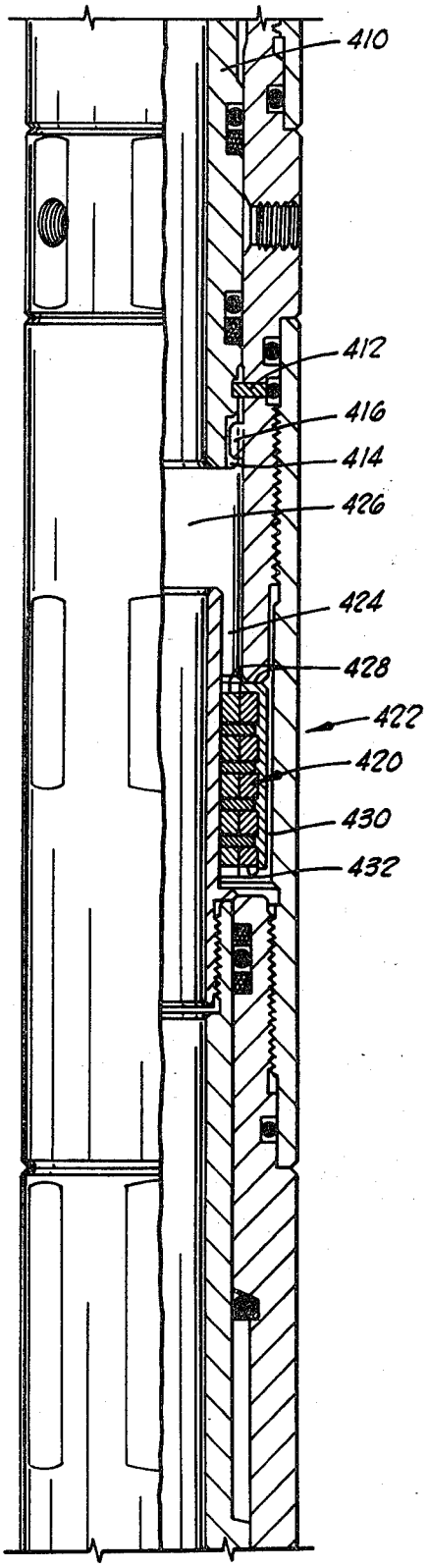
Figure 4C:
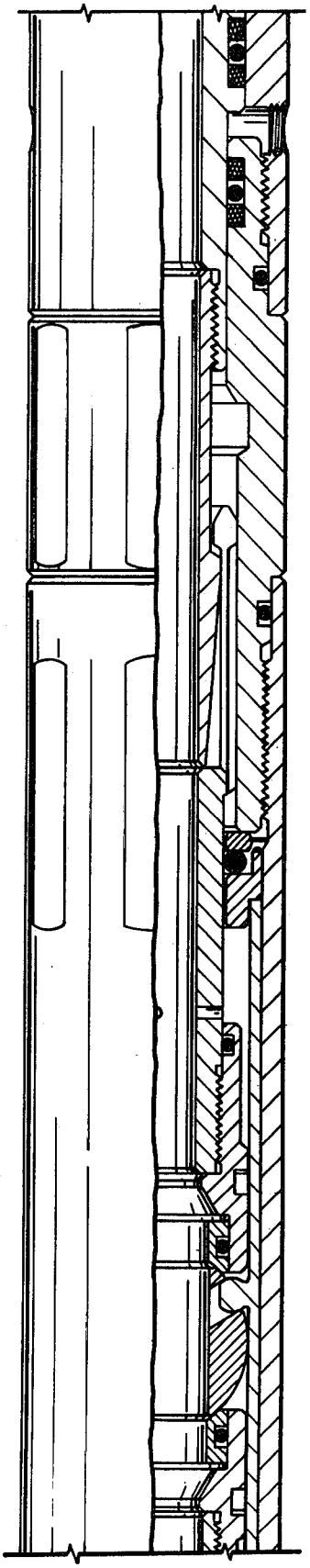
Figure 4D:
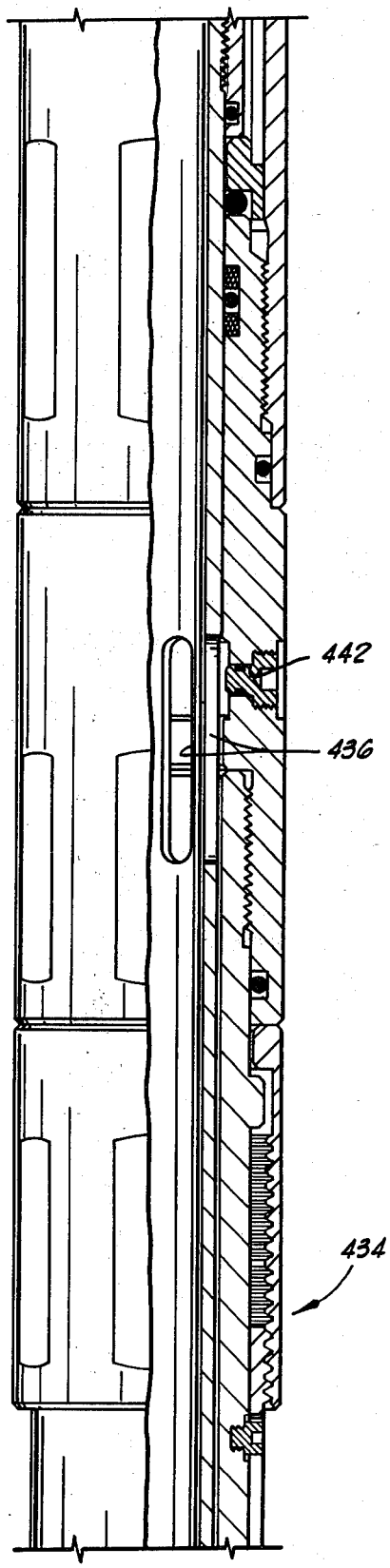
Figure 4E:
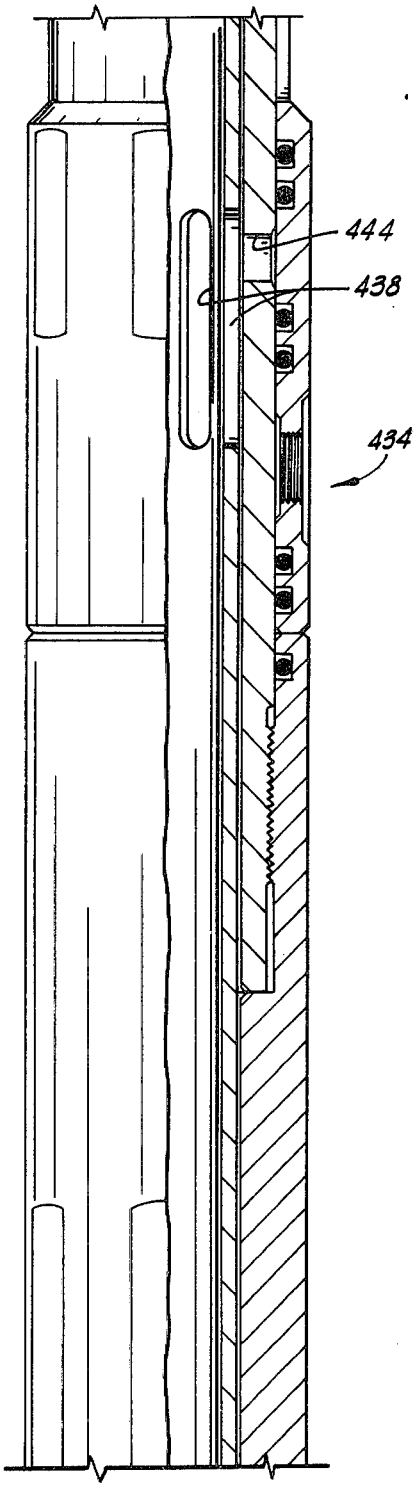
Figure 4F:
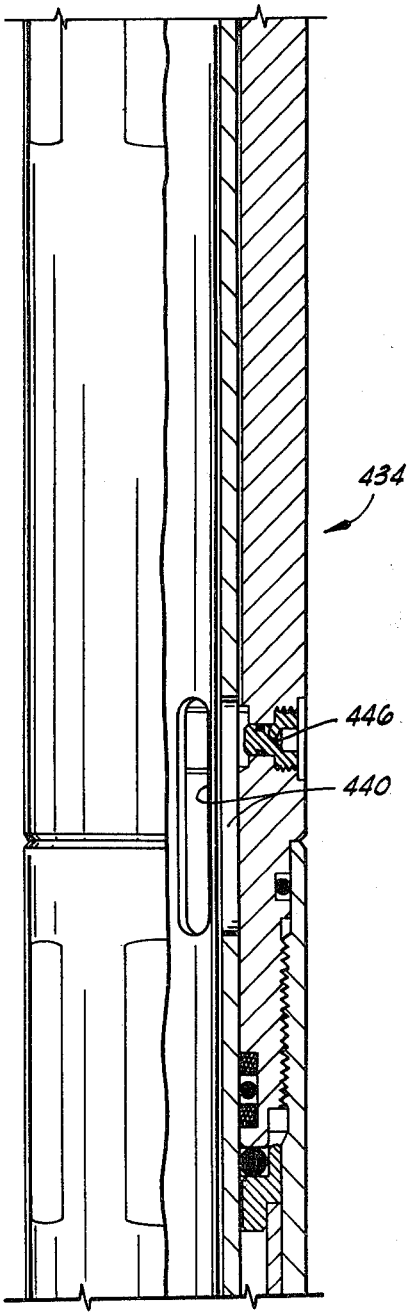
Figure 4G:
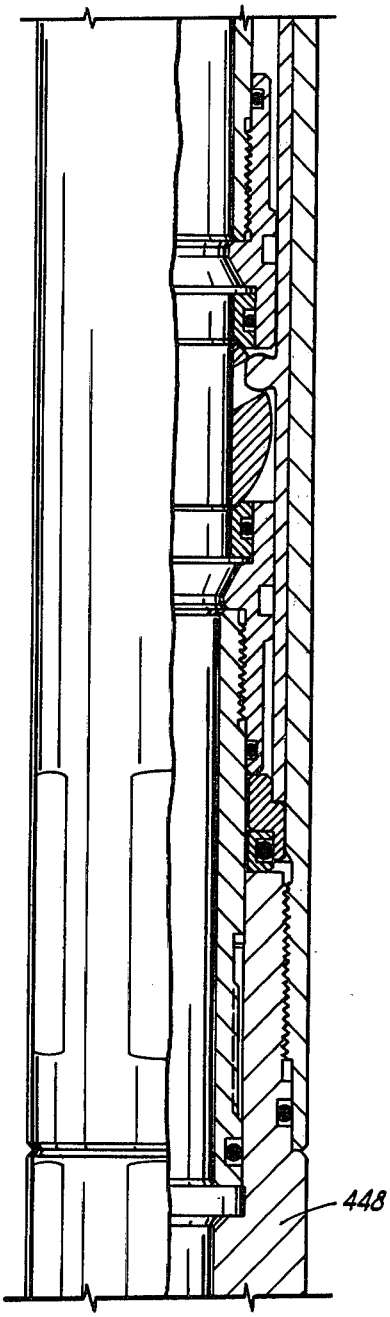
Figure 4H:
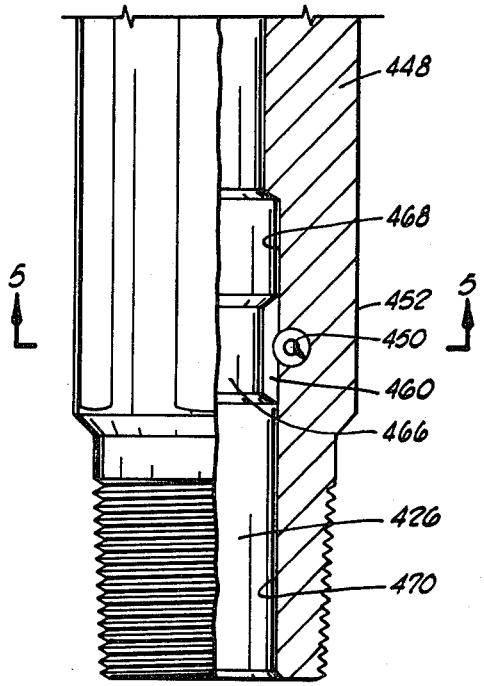
Figure 5:
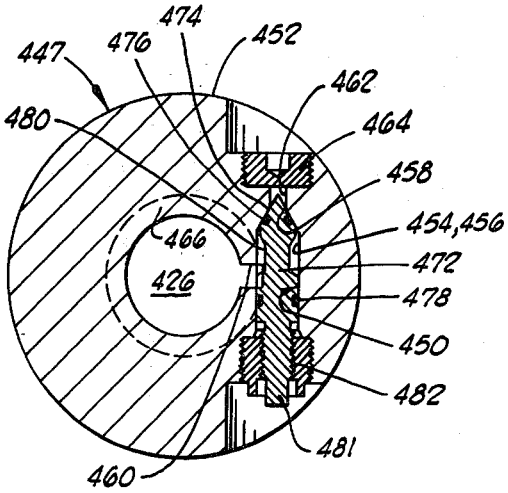

FIG. 5 is a cross sectional view taken about line 5—5 of FIG. 4H, showing an alternative embodiment of the drain valve below the sample chamber.

During the course of drilling an oil well, the borehole is filled with a fluid known as drilling fluid or drilling mud. One of the purposes of this drilling fluid is to contain in intersected formations any fluid which may be found there. To contain these formation fluids the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth and the formation fluid is allowed to flow into the string in a controlled testing program. Lower pressure is maintained in the interior of the testing string as it is lowered into the borehole. This is usually done by keeping a valve in the closed position near the lower end of the testing string. When the testing depth is reached, a packer is set to seal the borehole thus closing in the formation from the hydrostatic pressure of the drilling fluid in the well annulus.

The valve at the lower end of the testing string is then opened and the formation fluid, free from the restraining pressure of the drilling fluid, can flow into the interior of the testing string.

The testing program includes periods of formation flow and periods when the formation is closed in. Pressure recordings are taken throughout the program for later analysis to determine the production capability of the formation. If desired, a sample of the formation fluid may be caught in a suitable sample chamber.

At the end of the testing program, a circulation valve in the test string is opened, formation fluid in the testing string is circulated out, the packer is released, and the testing string is withdrawn.

Over the years various methods have been developed to open the tester valves located at the formation depth as described. These methods include string rotation, string reciprocation, and annulus pressure changes. One particularly advantageous tester valve is that shown in U.S. Pat. No. 3,856,085 to Holden, et al. This valve operates responsive to pressure changes in the annulus and provides a full opening flow passage through the tester valve apparatus.

The annulus pressure operated method of opening and closing the tester valve is particularly advantageous in offshore locations where it is desirable to the maximum extent possible, for safety and environmental protection reasons, to keep the blowout preventors closed during the major portion of the testing procedure.

A typical arrangement for conducting a drill stem test offshore is shown in FIG. 1. Such an arrangement would include a floating work station 1 stationed over a submerged work site 2. The well comprises a well bore 3 typically lined with a casing string 4 extending from the work site 2 to a submerged formation 5. The casing string 4 includes a plurality of perforations at its lower end which provide communication between the formation 5 and the interior of the well bore 6.

At the submerged well site is located the well head installation 7 which includes blowout preventor mechanisms. A marine conductor 8 extends from the well head installation to the floating work station 1. The floating work station includes a work deck 9 which supports a derrick 12. The derrick 12 supports a hoisting means 11. A well head closure 13 is provided at the upper end of marine conductor 8. The well head closure 13 allows for lowering into the marine conductor and into the well bore 3 a formation testing string 10 which is raised and lowered in the well by hoisting means 11.

A supply conduit 14 is provided which extends from a hydraulic pump 15 on the deck 9 of the floating station 1 and extends to the well head installation 7 at a point below the blowout preventors to allow the pressurizing of the well annulus 16 surrounding the test string 10.

The testing string includes an upper conduit string portion 17 extending from the work site 1 to the well head installation 7. A hydraulically operated conduit string test tree 18 is located at the end of the upper conduit string 17 and is landed in the well head installation 7 to thus support the lower portion of the formation testing string. The lower portion of the formation testing string extends from the test tree 18 to the formation 5. A packer mechanism 27 isolates the formation 5 from fluids in the well annulus 16. A perforated tail piece 28 is provided at the lower end of the testing string 10 to allow fluid communication between the formation 5 and the interior of the tubular formation testing string 10.

The lower portion of the formation testing string 10 further includes intermediate conduit portion 19 and torque transmitting pressure and volume balanced slip joint means 20. An intermediate conduit portion 21 is provided for imparting packer setting weight to the packer mechanism 27 at the lower end of the string.

It is many times desirable to place near the lower end of the testing string a conventional circulating valve 22 which may be opened by rotation or reciprocation of the testing string or a combination of both or by the dropping of a weighted bar in the interior of the testing string 10. This circulation valve is provided as a back-up means to provide for fluid communication in the event that the circulation valve of the present apparatus should fail to open properly. Also near the lower end of the formation testing string 10 is located a tester valve 25 which is preferably a tester valve of the annulus pressure operated type such as that disclosed in U.S. Pat. No. 3,856,085. Immediately above the tester valve is located the apparatus of the present invention 30.

A pressure recording device 26 is located below the tester valve 25. The pressure recording device 26 is preferably one which provides a full opening passageway through the center of the pressure recorder to provide a full opening passageway through the entire length of the formation testing string.

It may be desirable to add additional formation testing apparatus in the testing string 10. For instance, where it is feared that the testing string 10 may become stuck in the borehole 3 it is desirable to add a jar mechanism between the pressure recorder 26 and the packer assembly 27. The jar mechanism is used to impart blows to the testing string to assist in jarring a stuck testing string loose from the borehole in the event that the testing string should become stuck. Additionally, it may be desirable to add a safety joint between the jar and the packer mechanism 27. Such a safety joint would allow for the testing string 10 to be disconnected from the packer assembly 27 in the event that the jarring mechanism was unable to free a stuck formation testing string.

The location of the pressure recording device may be varied as desired. For instance, the pressure recorder may be located below the perforated tail piece 28 in a suitable pressure recorder anchor shoe running case. In addition, a second pressure recorder may be run immediately above the tester valve 25 to provide further data to assist in evaluating the well.

Referring now to FIGS. 2A–2F, the annulus pressure operated closure valve with improved power mandrel of the present invention is shown and generally designated by the numeral 30.

The apparatus 30 includes a cylindrical outer housing generally designated by the numeral 31, having an upper housing adapter 32 which includes threads 34 for attaching the apparatus 30 to the portion of the testing string 10 located above apparatus 30.

At the lower end of housing 31 is a lower housing adapter 36 which includes external threaded portion 38 for connection of apparatus 30 to a portion of test string 10 located below apparatus 30.

The apparatus 30 may be conveniently divided into three major assemblies including a middle power section 40, an upper circulation valve section 42 located above power section 40, and a lower sampler section 44 located below power section 40.

Power section 40 includes a power section housing including upper, middle and lower power section housing portions 46, 48, and and 50, respectively. Upper and middle portions 46 and 48 are joined together at threaded connection 52, and middle and lower portions 48 and 50 are joined together at threaded connection 54.

A power mandrel 56 is received within an open bore of housing 31 and includes an annular piston 58 which is closely received within an inner bore 60 of middle power section housing portion 48. A fluid tight seal between piston 58 and bore 60 is provided by O-rings 62 and back up rings 64. A power port 66 is disposed through a side wall of middle power section housing portion 48 and communicates fluid pressure exterior of the housing 31 to the lower end of piston 58 through passages 68, 70 and 72.

A cylindrical outer surface 74 of power mandrel 56 located above piston 58 is closely received within a second inner bore 76 of middle power section housing portion 48 and a fluid tight seal therebetween is provided by seals 78.

The seals 78 and the seals 62 serve to seal a low pressure chamber 80 between outer surface 74 of power mandrel 56 and first inner bore 60 of middle power section housing portion 48. It can thus be seen that there will be a differential pressure between the exterior pressure admitted by power port 66 and the pressure that is sealed within low pressure chamber 80.

Powder mandrel 56 includes a middle power mandrel portion 82 having upper and lower power mandrel portions 84 and 86 threadedly attached thereto.

An upper end surface 88 of middle power section housing portion 48 defines a radially inward projecting upward facing surface.

A radially inward projecting annular ridge 94 of upper power section housing 46 defines upward and downward facing annular surfaces 96 and 98, respectively.

An upper end 90 of middle portion 82 of power mandrel 56 defines a radially outward extending upward facing annular surface of power mandrel 56.

A frangible restraining means generally designated by the numeral 100 is located between an outer cylindrical surface 102 of upper portion 84 of power mandrel 56 and an inner cylindrical surface 104 of upper power section housing portion 46, between upward and downward facing surfaces 88 and 98 thereof.

Restraining means 100 provides a means for restraining movement of power mandrel 56 in an upward direction, which may generally be referred to as a first direction, until the pressure exterior of cylindrical housing 31 exceeds a predetermined value, and for frangibly releasing said power mandrel 56 when said pressure exterior of said housing 31 exceeds said predetermined value.

An elastomeric cushion ring 101 is located in low pressure chamber 80 to help absorb the shock as piston 58 of power mandrel 56 moves upward to the fully upward position under the influence of the pressure admitted by power port 66.

Restraining means 100 includes a carrying structure 106 comprising inner and outer concentric sleeves 108 and 110, having a plurality of shear pins 112 disposed radially therethrough connecting the inner and outer concentric sleeves 108 and 110. A shear pin cover 114 surrounds outer sleeve 110 to hold shear pins 112 in place within the concentric sleeves 108 and 110.

Carrying structure 106 is arranged for force transmitting engagement with radially extending upward facing surface 90 of power mandrel 56 upon movement of power mandrel 56 in an upward direction. The surface 90 engages a lower surface 116 of inner sleeve 108.

A shock absorber means 118 is disposed between downward facing surface 98 and an upper end 120 of outer sleeve 110 for absorbing a longitudinal impacting force exerted upon carrying structure 106, and for preventing deformation of shear pins 112 due to fluctuations of pressure exterior of housing 31 until said pressure exterior of housing 31 exceeds the predetermined value at which shear pins 112 are designed to be sheared.

In order to move power mandrel 56 upwards, the pressure of the drilling fluid exterior of housing 31 within well annulus 16 is increased to said predetermined value. The pressure differential between this pressure exterior of housing 31 and the lower pressure sealed within low pressure chamber 80, acting across annular piston 58, exerts an upward force on power mandrel 56 which is transmitted to inner sleeve 108 of carrying structure 106 by engagement of surfaces 90 and 116. Outer sleeve 110 engages shock absorber means 118 and when the pressure exterior of housing 31 reaches a predetermined level, the longitudinal shear forces acting between sleeves 108 and 110 causes shear pins 112 to be sheared upon relative longitudinal movement between inner and outer concentric sleeves 108 and 110.

The number of shear pins 112 may be varied to set the value of the pressure differential required to shear the pins 112 and release mandrel 56.

Means are provided in the apparatus 30 for preventing damage to shear pins 112 due to fluctuations in the well annulus pressure below the pressure at which the shear pins 112 are designed to be sheared, and to prevent damage from fluctuation in pressure within the central bore 122 of housing 31.

The means for preventing damage due to pressure fluctuations in annulus 16 outside of housing 31 is provided by shock absorber means 118. Shock absorber means 118 is an annular longitudinally resilient ring. This annular ring has a plurality of longitudinally spaced peripherally extending slots, three of which are visible in FIG. 2, including slots 124, 126 and 128. The longitudinal resilience of shock absorber ring 118 is provided by longitudinal compression of ring 118 to narrow the slots such as slots 124, 126 and 128. By "longitudinal" reference is made to the directions parallel to the longitudinal central axis of cylindrical housing 31.

Each of the slots 124, 126 and 128, includes an angle of less than 360°, and there are generally several peripherally spaced slots along a common circumference of annular ring 118. Furthermore, the closest longitudinally spaced slots, such as slots 124 and 126 are peripherally staggered so that their ends are not located directly one above the other.

It is noted that restraining means 100 is located on an opposite side of piston 58 of power mandrel 56 from power port 66. Furthermore, restraining means 100 is in fluid isolation from fluid pressure exterior of cylindrical housing 31.

When the testing string 10 including the apparatus 30 is run into the casing string 4, pressure fluctuations in the fluid exterior of housing 31 are often created. Those fluctuations provide fluctuating upward forces on piston 58 of power mandrel 56. The shock absorber means 118 is sufficiently resilient that impacting shock forces from power mandrel 56 applied to inner sleeve 108 of carrying structure 106 are absorbed by shock absorber 118 so as to minimize the impact loading across shear pins 112.

The means for preventing damage to shear pins 112 due to fluctuating internal pressure within bore 122 of cylindrical housing 31 is provided by an interior pressure balance means. This interior pressure balance means includes a first port 130 disposed through upper portion 84 of power mandrel 56 for communicating open bore 122 with the upper end of carrying structure 106. Also included is a second port 132 which communicates inner bore 122 with the lower end of carrying structure 106 through an annular clearance 134 between middle portion 58 of power mandrel 56 and inner bore 76 of middle power section housing portion 48.

An upper surface area of the upper ends of concentrical sleeves 108 and 110 exposed to said interior pressure from said inner bore 122 is equal to a lower surface area of the lower ends of sleeves 108 and 110 exposed to said interior pressure, so that all longitudinal forces applied to carrying structure 106 by pressure within bore 122 are balanced across carrying structure 106. This prevents any longitudinal shear forces from being applied to pins 112 due to fluctuations in pressure within bore 122.

Circulation valve section 42 includes an upper circulation valve housing portion 136 and a lower circulation valve housing portion 138. Lower circulation valve housing portion 138 is threadedly connected to upper power section housing portion 46 at threaded connection 140.

Slidingly received within an inner bore 142 of lower circulation valve housing portion 138 is a valve mandrel 144. Valve mandrel 144 is shown in FIG. 2A–B, in its closed position closing a circulating port 146, with upper and lower annular seals 148 and 150 located between mandrel 144 and bore 142 sealing above and below circulating port 146.

Valve mandrel 144 is initially retained in its closed position by a valve mandrel shear pin 152 which is disposed through a radial bore 154 through lower valve housing portion 138 and received within a radially extending bore 156 of valve mandrel 144. Shear pin 152 is retained in place by a resilient retaining ring 158.

An annular upper end surface 160 of lower valve housing portion 138 defines a radially inward projecting ledge of cylindrical housing 31.

Valve mandrel 144 includes a lower valve mandrel portion 162 and an upper valve mandrel portion 164. Upper valve mandrel portion 164 includes an externally threaded lower end portion 166 which is threadedly engaged with an internally threaded upper end portion 168 of lower valve mandrel portion 162. Upper valve mandrel portion 164 includes a radially outward projecting annular ledge 170 located above radially inward projecting ledge 160 of cylindrical housing 31.

A coil compression 172 has its upper end engaging outward projecting ledge 170 of upper valve mandrel portion 164, and has its lower end engaging radially inward projecting ledge 160 of cylindrical housing 31. Spring means 172 provides a means for moving sliding valve mandrel 144, from its closed position, as shown in FIG. 2A–B, to an open position with valve mandrel 144 moved upward relative to cylindrical housing 31 so that circulating port 146 is uncovered and allowed to communicate with inner bore 122 of cylindrical housing 31.

Spring means 172 is initially retained in a compressed state until shear pin 152 is sheared and then spring means 172 moves valve mandrel 144 upward to its open position upon expansion of coil compression spring means 172.

A lower end 174 of valve mandrel 144 is arranged for engagement with an upper end 176 of upper portion 84 of power mandrel 56 upon movement of power mandrel 56 in an upward direction. Upon engagement of upper end 176 of power mandrel 56 with lower end 174 of valve mandrel 144 an upward force is exerted on valve mandrel 144 which shears shear pin 152 thereby releasing valve mandrel 144. Valve mandrel 144 is forced to move in said upward direction by said engagement with power mandrel 56. After this upward movement shears shear pin 152, further upward movement of valve mandrel 144 is assisted by expansion of coil compression spring means 172 as previously described. Also, coil compression spring means 172 prevents valve mandrel 144 from returning to its closed position.

Upward movement of valve mandrel 144 is limited by engagement of radially outward projecting ledge 170 with a lower end 178 of upper housing adapter 32.

The full opening sampler section 44 includes a sample chamber 180 in the open bore 122 of the apparatus 30. The sample chamber 180 is formed by the closing of upper and lower full opening ball valves 182 and 184, respectively.

The two ball valves 182 and 184 are simultaneously operated by a dual ball valve operating assembly which includes a sampler pull mandrel 186 is releasably attached to the lower portion 86 of the power mandrel 56 by a plurality of spring fingers 188. Each spring finger 188 is terminated by a head 190. Each of the heads 190 is forced by the lower power section housing portion 50 into a groove 192 in the lower portion 86 of power mandrel 56.

The lower power section housing portion 50 also includes an annular releasing recess 194.

The spring fingers 188 of the sampler pull mandrel 186 are outwardly biased so that when the heads 190 are pulled by the lower portion 86 of power mandrel 56 to the releasing recess 194, the spring finers 188 snap outwardly moving heads 190 into the releasing recess 194. This action disconnects the sampler pull mandrel 186 from the groove 192 in the lower portion 86 of the power mandrel 86.

The dual ball operating mechanism additionally includes an upper seat retainer 196 for the upper ball valve 182 which retains the upper valve seat 198. Below seat 198 is the upper ball valve 182 and its associated lower valve seat 200.

The lower valve seat 200 is carried by a lower seat retainer 202, the lower end of which is attached to an operating pull mandrel 204 for operating the lower ball valve 184. The upper seat 198 and lower seat 200 are held in sealing engagement with ball valve 182 by C-clamps 205 which are fitted into groove 206 in upper seat retainer 198 and groove 208 in lower seat retainer 202.

Located between upper seat 198 and upper seat retainer 196 is an upper ball valve spacer ring 199. Located between lower seat 200 and lower seat retainer 202 is an upper ball valve biasing spring 201 which is a Belleville spring. The longitudinal dimension of spacer 199 and biasing spring 201 are preferably equal.

Threadedly attached to the lower end of operating pull mandrel 204 is an upper seat retainer 210 for lower ball valve 184. An upper valve seat 212 is retained in upper seat retainer 210.

The lower valve seat 214 is retained in a lower valve seat retainer 216 of lower ball valve 184. Upper and lower seats 212 and 214 are held in sealing engagement with lower ball valve 184 by C-clamps 218 which are fitted into grooves 220 in upper seat retainer 210 and grooves 222 in lower seat retainer 216.

Located between upper seat 212 of lower ball valve 184 and upper seat retainer 210 is a biasing spring 211 which is preferably a Belleville type spring. Located between lower seat 214 and lower seat retainer 216 is a lower ball valve spacer ring 215 which is preferably of the same longitudinal dimension as biasing spring 211.

The lower seat retainer 216 is threadedly attached to a locking mandrel 224.

It can thus been see that as power mandrel 56 moves in an upward direction under the influence of annulus well pressure acting upon piston 58, that the entire ball operating assembly comprised of sampler pull mandrel 186, upper seat retainer 196, upper ball valve 182 with its associated valve seats 198 and 200, lower retainer 202, operating pull mandrel 204, upper retainer 210, lower ball valve 184 and its associated seats 212 and 214, lower seat retainer 216 and locking mandrel 224 all move in the upward direction as long as heads 190 of spring fingers 188 are engaged with groove 192 of lower portion 96 of power mandrel 56. During this upward movement, upper ball valve 182 will be rotated to the closed position by the action of a pin 226 in a hole 228 of ball valve 182. Likewise, lower ball valve 184 will be rotated to the closed position by the action of a pin 230 in a hole 232 of ball valve 184.

The ball operating assembly of sampler section 44 is enclosed in a portion of cylindrical housing 31 comprised of an upper ball valve case 234 attached to lower power section housing portion 50, a first seal adapter 236 attached to upper ball valve case 234, a drain housing 238 attached to first seal adapter 236, a second seal adapter 240 attached to drain housing 238, and a lower ball valve case 242 having its upper end attached to second seal adapter 240 and having its lower end attached to lower adapter 36.

Pin 226 extends inwardly from an upper pin mandrel 244 which is held in position in upper ball valve case 234 by upper and lower cushion retainers 246 and 248. An annular O-ring cushion 250 is retained in upper cushion retainer 246 by a backup ring 252. Another cushion 254 is retained in lower cushion retainer 248 and held in place by an upper end 256 of first seal adapter 236.

The cushions 250 and 254 assist in absorbing shocks transmitted to the upper pin mandrel 244 by the operation of the upper ball valve 182 as it is moved between its open and closed positions.

Likewise, pin 230 is an inwardly directed portion of a lower pin mandrel 258 which is held in position within lower ball valve case 242 by an upper cushion retainer 260 and a lower lock means retainer 262. A cushion 264 is retained in upper cushion retainer 260 and held in place by engagement with a lower end 266 of second seal adapter 240.

Retained within lock means retainer 262 are a plurality of locking dogs 268 which are retained in place about an outer cylindrical surface 270 of locking mandrel 224 and are inwardly biased by a resilient O-ring 272 located in outwardly directed channels 274 of locking dogs 268.

When locking mandrel 224 is moved upward a sufficient distance the locking dogs 268 are moved radially inward into locking engagement with an annular locking groove 276 in outer surface 270 of locking mandrel 224. The engagement of locking dogs 268 with locking groove 276 prevents further movement of the ball operating assemblies of sampler section 44 and locks upper and lower ball valves 182 and 184 in their closed positions.

The various components of the sampler section 44 are so arranged and constructed as to provide considerable standardization of parts. This standardization is in part due to the longitudinal dimension of spacer ring 252.

Upper ball valve case 234 is identical to lower ball valve case 242. First seal adapter 236 is identical to second seal adapter 240. Upper pin mandrel 244 is identical to lower pin mandrel 258. Cushion retainers 246, 248, 260 and locking means retainer 262 are all identical. Upper seat retainer 196, lower seat retainer 202, upper seat retainer 210 and lower seat retainer 216 are all identical. Cushions 250, 254 and 264 are all identical. Belleville springs 201 and 211 are identical. Spacers 199 and 215 are identical.

Sampler pull mandrel 186 includes a port 278 to prevent hydraulic lock up of the operating assembly due to fluids trapped between the operating assembly and the upper pin mandrel 244.

It is noted that when the apparatus 30 is being used as a sampler, that is, with the sampler section 44 including both upper and lower ball valves 182 and 184, no seal is provided between locking mandrel 224 and lower adapter 36. This allows fluids trapped between the lower portion of the operating assembly and the lower pin mandrel 258 to escape into the inner bore 122 to prevent hydraulic lockup.

Drain housing 238 includes a drain port 280 disposed through a wall thereof. Drain port 280 communicates with sample chamber 180 through a longitudinal slot 282 in operating pull mandrel 204. Slidably disposed about an outer cylindrical surface 284 of drain housing 238 is a sliding drain valve sleeve 286. An upper end 288 of drain valve sleeve 286 includes radially outer threads 290 which are engaged with an inner threaded portion 292 of rotatable drain valve actuating collar 294.

A radially inward projecting annular ledge 296 of actuating collar 294 is retained between a lower end 298 of first seal adapter 236 and a radially outward projecting annular ledge 300 of drain housing 238.

The longitudinal position of actuating collar 294 relative to drain housing 238 is therefore fixed with inward projecting ledge 296 being located between the downward facing surface of lower end 298 and the upward facing surface of outward projecting ledge 300. As actuating collar 294 is rotated, the threaded engagement between threads 292 and 290 causes drain valve sleeve 286 to move longitudinally relative to drain housing 238.

A lug 302 is threadedly attached to drain housing 238 at threaded connection 304 and extends radially outward through a longitudinal slot 306 of drain valve sleeve 286 so as to prevent relative rotational movement between drain valve sleeve 286 and drain housing 238 and to properly align drain port 280 and sleeve port 308. Therefore, as actuating collar 294 is rotated, the drain valve sleeve 286 is moved longitudinally relative to drain housing 238 without being permitted to rotate relative thereto.

Drain valve sleeve 286 is shown in FIGS. 2D–E in its closed position with upper seals 310 and lower seals 312 located above and below drain port 280 to close drain port 280 and isolate drain port 280 from sleeve port 308. The lowermost downward position of sleeve 286 relative to drain housing 238 is defined by engagement of a lower end 316 of sleeve 286 with an upper end 320 of second seal adapter 240.

After the apparatus 30 has been removed from the well bore 3, it is necessary to remove the sample from the sample chamber 180 for testing of the sample. A suitable sample receiving apparatus is threadedly connected to threaded drain sleeve port 308 while the drain sleeve 286 is in its closed position. Then, the actuating collar 294 is rotated to move drain sleeve 286 upward until drain valve sleeve port 308 is in communication with drain port 280. This is the open position of drain valve sleeve 286. In this open position, seals 312 are located above drain port 280 and an additional pair of seals 314 are located below drain port 280.

A second drain port (not shown) and a second drain valve sleeve port (not shown) are disposed 180° opposite ports 280 and 308 in drain housing 238 and drain sleeve 286, respectively.

After the pressure trapped within sample chamber 180 has been bled off through drain port 280 and sleeve port 308 as just described, it is sometimes desirable to purge the sample chamber 180. This may be accomplished by means of upper and lower purge ports 320 and 322 disposed through the walls of first and second seal adapters 236 and 240, respectively. The purge ports 320 and 322 and the longitudinal slot 282 of operating mandrel 204 are so arranged and constructed that the purge ports 320 and 322 are in communication with slot 282 when the upper and lower ball valves 182 and 184 are in their closed positions.

Ports 320 and 322 are normally sealed by plugs 324 and 326, respectively. After the pressure is bled off from sample chamber 180, the plugs 324 and 326 may be removed so as to allow connection of suitable supply and return conduits for directing a purging fluid into the sample chamber 180 and receiving said purging fluid therefrom after it has flowed through the sample chamber 180, thereby purging the same.

As set out above, the present apparatus is most advantageous when run with an annulus pressure operated tester valve 25 (See FIG. 1) such as the one shown in U.S. Pat. No. 3,856,085. When run with such a tester valve 25, it is desirable to provide a means to drain well fluids trapped between lower ball valve 184 and the tester valve 25 located below the present apparatus 30 in the testing string 10. Thus, a drain passage 328 is provided in lower adapter 36 to allow the draining of formation fluid trapped between the lower ball valve 182 and the tester valve 25. A plug valve similar to the one shown in FIG. 3 may be used in conjunction with passageway 328.

FIG. 3 is a sectional view taken along line 3—3 of FIG. 2F. Drain passage 328 includes a first transverse bore 330 disposed in the wall of lower adapter 36 in which is received a plug valve 332.

A second transverse bore 334 communicates the inner bore 122 of cylindrical housing 31 with first bore 330.

A third transverse bore 336 communicates first bore 330 with an outer surface 338 of lower adapter 36. Located within a threaded counterbore 340 of third bore 336, is a drain plug 342.

As shown in FIG. 3, the plug valve 332 is in a closed position with seals 344 and 346 sealing on both sides of second bore 334.

Plug valve 332 includes a threaded portion 348 which engages a threaded portion 350 of a valve insert 352, so that upon rotation of valve 332, such as may be accomplished by attaching a wrench or other suitable device to outward projecting end 354 of valve 332, the valve 332 is moved in an outward direction toward valve insert 352 until seals 346 move past second bore 334 thereby allowing fluid communication of second bore 334 with third bore 336 through first bore 330.

After the apparatus 30 has been removed to the surface at the conclusion of the testing program, and before the draining procedures just described, it is desirable to be able to disassemble the apparatus 30 and integral sample chamber section. This is desirable in that only the sample chamber 180 filled with formation fluid needs to be transferred to a laboratory for testing. Also, by providing a separable sample chamber, it is possible to transfer the fluid sample from the drilling rig to the laboratory without the possibility of contamination of the well fluid sample.

To facilitate the disassembly of the apparatus into a separable sample section, the threaded connection 54 between middle power section housing portion 48 and lower power section housing 50 is provided to allow the sampler section 44 to be separated from the power section 40 and the circulating valve section 42.

Many times it is desirable to operate the apparatus 30 as a safety closure valve rather than a sampler section. For that reason the shear pins 112 of apparatus 30 are designed to shear at a higher pressure, e.g. 2500 psi, than that at which valve 25 operates, e.g. 1500 psi.

In these cases it may not be required or desirable to trap a sample of formation fluid. However, it is always desirable to have a safety valve which closes as the circulation valve mandrel 144 is opened to ensure that the open bore of the formation testing string 10 is closed in the event of failure of the tester valve 25 in the case of a drill stem test, or if the apparatus 30 is used as a safety valve during oil well drilling or in a projecting string.

The apparatus 30 is so constructed that the bottom ball valve 184 may be removed from the apparatus 30. The upper ball valve 182 is then used as an emergency closure valve which operates in conjunction with the circulation valve sleeve 144.

To remove the bottom ball valve 184, the apparatus 30 is separated at a threaded connection 354 between upper ball valve case 234 and first seal adapter 236, and a threaded connection 356 between lower ball valve case 242 and lower adapter 36. The operating pull mandrel 204 is then removed and the locking mandrel 224 is substituted therefor with a threaded upper end 358 of locking mandrel 224 engaging inner threads 360 of lower seat retainer 202 of upper ball valve 182. The external threads at the upper end of lower adapter 36 are then engaged with the internal threads at the lower end of upper ball valve case 234.

In this configuration, an O-ring seal (not shown) is disposed in an annular groove 362 of locking mandrel 224 to prevent fluid communication between locking mandrel 224 and lower adapter 36. Also, the cushion 254 is replaced with the locking dogs 268 and resilient ring 272.

An alternative embodiment of the apparatus of the present invention is shown in FIGS. 4A–4H and is generally designated by the numeral 400. The apparatus 400 is very similar to apparatus 30 of FIGS. 2A–2F, but includes numerous modifications as compared to the apparatus 30. The following description of the apparatus 400 is concentrated primarily on those components which are somehow changed from the similar components of apparatus 30.

In the apparatus 400, the upper circulation valve housing portion 136 and the upper housing adapter 32 have been combined into an integral upper housing member 402 of cylindrical housing 403.

Apparatus 400 includes a circulation valve section 404 which includes a circulation valve mandrel 406 having upper and lower valve mandrel portions 408 and 410, respectively. A shear pin 412 is connected between the lower valve mandrel portion 410 and the housing 403, near the lower end of lower valve mandrel portion 410.

The lower end of lower valve mandrel portion 410 includes a plurality of radially outward projecting splines 414. Splines 414 mesh with a second plurality of splines 416 projecting radially inward from housing 403.

Splines 414 and 416 provides a guide means, other than shear pin 412, for preventing relative rotational movement between housing 403 and lower valve mandrel portion 410 when shear pin 412 is in place between valve mandrel 406 and housing 403. This allows the upper valve mandrel portion 408 to be rotated relative to the lower valve mandrel portion 410 to compress coil spring 418 during assembly of apparatus 400, without exerting rotational shear forces on pin 412. This arrangement prevents unintentional shearing of shear pin 412 during assembly of the apparatus 400.

The design of the frangible restraining means 420 and its associated structure in power section 422 as shown in FIG. 4B is also changed. There is no shock absorber means such as shock absorber means 118 of apparatus 30.

The interior pressure balance means for frangible restraining means 420 includes an annular passage 424 which communicates open bore 426 of housing 403 with the upper end 428 of frangible restraining means 420. Annular passage 424 communicates with an annular clearance 430 between frangible restraining means 420 and housing 403. Clearance 430 also communicates with lower end 432 of frangible restraining means 420 so that the interior pressure in open bore 426, and a longitudinal force caused thereby, is balanced across frangible restraining means 420 to prevent longitudinal loading of said frangible restraining means due to said interior pressure. This arrangement eliminates the need for ports 130 and 132 of apparatus 30.

In the sampler section 434 of FIGS. 4D–4F of long slot 282 of apparatus 30 has been replaced with a plurality of longitudinally spaced shorter slots or opening means 436, 438 and 440 adjacent upper purge port 442, drain port 444 and lower purge port 446, respectively.

Referring now to FIGS. 4H and 5, an alternative drain valve 447 is shown for use below sampler section 434. A lower housing adapter 448 has a drain passage, generally designated by the numeral 450, disposed therein communicating open bore 426 with an outer surface 452 of housing 403.

A first portion 454 of passage 450 is defined by a transverse bore 456 having a tapered annular surface 458 at an end thereof.

A second portion 460, of passage 450, communicates bore 426 with an intermediate part of transverse bore 456. Second portion 460 comprises a longitudinal slot 460 disposed in bore 426 and intersecting transverse bore 456.

Slot 460 is disposed in a radially inward projecting annular ledge 466 of lower housing adapter 448 so that slot 460 communicates an upper enlarged inner diameter portion 468 of bore 426 located above ledge 466 with a lower enlarged inner diameter portion 470 of bore 426 located below ledge 466.

A third portion 462, of passage 450, communicates transverse bore 456 with outer surface 452. Third portion 462 is temporarily blocked with a threaded plug 464. Plug 464 must be removed prior to opening drain valve 447.

A cylindrical valve member 472 is closely received in transverse bore 456 and has a tapered end 474 adapted for engagement with tapered annular surface 458.

A first seal means 476 is provided for sealing between tapered end 474 and tapered annular surface 458. A second seal means 478 is provided for sealing between cylindrical valve member 472 and transverse bore 456.

A recess 480, comprising a reduced diameter outer surface of cylindrical valve member 472, communicates slot 460 with tapered annular surface 458.

A second end 481 of cylindrical valve member 472 includes outer threads 482 which provide a means for moving valve member 472 by rotation thereof for selectively moving tapered end 474 into and out of engagement with tapered annular surface 458.

The drain valve 447 is shown in a closed position in FIG. 5. To open drain valve 447 the plug 464 is removed and cylindrical valve member 472 is rotated by attachment of a suitable operating tool to second end 481 to move tapered end 474 out of engagement with tapered annular surface 458.

Thus, the apparatus of the present invention is well adapted to attain the ends and advantages mentioned as well as those inherent therein. While presently preferred embodiments of the invention have been described for the purpose of this disclosure, numerous changes in the construction and arrangement of parts can be made by those skilled in the art, which changes are encompassed in the scope of this invention as defined by the appended claims.

What is claimed is:

1. In combination with an apparatus for use in a well, said apparatus including:

a cylindrical housing having an open bore therethrough, and a power port and a circulating port through the walls thereof;

a power mandrel in said open bore having an annular piston for moving said power mandrel in a first direction responsive to fluid pressure exterior of said cylindrical housing communicated to said annular piston through said power port;

frangible restraining means between said power mandrel and said cylindrical housing for restraining movement of said power mandrel in the first direction until the pressure exterior of said housing exceeds a predetermined value, and for frangibly releasing said power mandrel when said pressure exterior of said housing exceeds said predetermined value;

closure valve means in said cylindrical housing having a normally open position and a closed position for providing a flow passageway through the open bore in said housing when in the normally open position;

connecting means connecting said closure valve means to said power mandrel including means for moving said closure valve from the open position to a closed position responsive to movement of said power mandrel in the first direction;

first releasing means in said connecting means for selectively releasing said connecting means from said power mandrel after said power mandrel has moved a predetermined distance in the first direction; and circulation valve means in said housing including a sliding valve mandrel having a normally closed position closing said circulating port and an open position opening said circulating port, said circulation valve means including means for moving said sliding valve mandrel from the closed position to the open position responsive to a predetermined amount of movement of said power mandrel in the first direction;

the improvement comprising:

said circulation valve means including shear pin means for initially retaining said sliding valve mandrel in said normally closed position; and said sliding valve mandrel being arranged for engagement with said power mandrel upon movement of said power mandrel in said first direction, so that said sliding valve mandrel is forced in said first direction by said engagement with said power mandrel and said shear pin means is sheared to release said sliding valve mandrel.

2. The combination of claim 1, wherein:

said means for moving said sliding valve mandrel from the closed position to the open position includes spring means for moving said sliding valve mandrel to its said open position upon shearing of said shear pin means.

3. The combination of claim 2, wherein:

said spring means is further characterized as including a coil spring means initially retained in a compressed state until said shear pin means is sheared, said coil spring means being arranged to move said sliding valve mandrel to its said open position upon expansion of said coil spring means.

4. An apparatus for use in a well, comprising:

a cylindrical housing having an open bore therethrough, and a power port and a circulating port through the walls thereof;

a power mandrel in said open bore having an annular piston for moving said power mandrel in a first direction responsive to fluid pressure exterior of said cylindrical housing communicated to said annular piston through said power port; and circulation valve means, including:

a valve mandrel slidably received in said housing and movable from a closed position closing said circulating port to an open position opening said circulating port; and shear pin means for initially retaining said valve mandrel in said closed position, said valve mandrel being arranged and constructed for engagement with said power mandrel upon movement of said power mandrel in said first direction so that said valve mandrel is forced in said first direction by said engagement with said power mandrel and said shear pin means is sheared to release said valve mandrel.

5. The apparatus of claim 4, further comprising:

spring means for moving said valve mandrel to its said open position upon shearing of said shear pin means.

6. The apparatus of claim 5, wherein:

said spring means is further characterized as including a coil spring means initially retained in a compressed state until said shear pin means is sheared, said coil spring means being arranged to move said valve mandrel to its said open position upon expansion of said coil spring means.

7. The apparatus of claim 5, wherein:

said valve mandrel includes a radially outward projecting ledge at an upper end thereof;

said cylindrical housing includes a radially inward projecting ledge located below said radially outward projecting ledge of said valve mandrel; and said spring means includes a coil compression spring disposed about said valve mandrel and having an upper spring end engaging said radially outward projecting ledge of said valve mandrel and a lower spring end engaging said radially inward projecting ledge of said housing.

8. The apparatus of claim 5, further comprising:

means for limiting movement of said valve mandrel in said first direction.

9. The apparatus of claim 5, further comprising:

first and second seal means, between said valve mandrel and said housing, for sealing above and below said circulating port when said valve mandrel is in its said closed position.

10. A circulation valve for use in a well, comprising:

a cylindrical housing having an open bore therethrough and a circulating port through a wall thereof;

a valve mandrel slidably received in said housing and movable from a closed position closing said circulating port to an open position opening said circulating port;

shear pin means for initially retaining said valve mandrel in said closed position;

spring means for moving said valve mandrel to its said open position upon shearing of said shear pin means;

wherein said valve mandrel includes a radially outward projecting ledge at an upper end thereof;

wherein said cylindrical housing includes a radially inward projecting ledge located below said radially outward projecting ledge of said valve mandrel; and wherein said spring means includes a coil compression spring disposed about said valve mandrel and having an upper spring end engaging said radially outward projecting ledge of said valve mandrel and a lower spring end engaging said radially inward projecting ledge of said housing.

11. The circulation valve of claim 10, wherein:

said cylindrical housing includes a first housing portion, said circulating port being disposed through a wall of said first housing portion, and a second housing portion having an internally threaded lower end threadedly engaging an externally threaded upper end of said first housing portion, so that said radially inward projecting ledge of said housing is defined by an annular end surface of said upper end of said first housing portion.

12. The circulation valve of claim 11, wherein:

said valve mandrel is slidingly received within said first housing portion; and said shear pin means is connected between said valve mandrel and said first housing portion.

13. The circulation valve of claim 11, wherein:

said valve mandrel includes a first valve mandrel portion slidingly received within said first housing portion, and a second valve mandrel portion including said radially outward projecting ledge, said second valve mandrel portion having a lower end connected to said first valve mandrel portion; and said shear pin means is connected between said first valve mandrel portion and said first housing portion.

14. The circulation valve of claim 10, wherein:

said valve mandrel includes a first valve mandrel portion slidingly received within said cylindrical housing, and a second valve mandrel portion including said radially outward projecting ledge, said second valve mandrel portion having a lower end threadedly connected to said first valve mandrel portion; and said shear pin means is connected between said first valve mandrel portion and said cylindrical housing.

15. The circulation valve of claim 14, further comprising:

guide means, other than said shear pin means, for preventing relative rotational movement between said cylindrical housing and said first valve mandrel portion when said shear pin means is in place between valve mandrel and said cylindrical housing, so that said second valve mandrel portion may be rotated relative to said first valve mandrel portion to compress said coil spring without exerting rotational shear force on said shear pin means.

16. The circulation valve of claim 15, wherein:

said guide means comprises a first plurality of splines projecting radially outward from said first valve mandrel portion and meshed with a second plurality of splines projecting radially inward from said cylindrical housing.

17. The circulation valve of claim 14, further comprising:

a first plurality of splines projecting radially outward from said first valve mandrel portion and meshed with a second plurality of splines projecting radially inward from said cylindrical housing.

18. A drain valve apparatus, comprising:

a housing having a longitudinal bore disposed therein;

a drain passage disposed in a wall of said housing and connecting said longitudinal bore with an outer surface of said housing, a first portion of said drain passage being defined by a transverse bore having a tapered annular surface at a first end thereof, a second portion of said passage communicating with said longitudinal bore and intersecting an intermediate part of said transverse bore between said tapered annular surface and a second end of said transverse bore, and a third portion of said passage communicating said first end of said transverse bore with said outer surface of said housing;

a cylindrical valve member closely received in said transverse bore with a tapered end adapted for engagement with said tapered annular surface, and having a recess disposed therein communicating said second portion of said drain passage with said tapered annular surface; and means for selectively moving said tapered end of said valve member into and out of engagement with said tapered annular surface.

19. The apparatus of claim 18, further comprising:

first seal means for sealing between said tapered end of said valve member and said tapered annular surface; and second seal means for sealing between said cylindrical valve member and said transverse bore; and wherein said recess in said valve member is located between said first and second seal means.

20. The apparatus of claim 18, wherein:

said recess comprises a reduced diameter outer surface of said valve member.

21. The apparatus of claim 18, wherein:

said second portion of said drain passage comprises a longitudinal slot disposed in said inner bore of said housing.

22. The apparatus of claim 21, wherein:

said slot intersects said transverse bore.

23. A drain valve apparatus, comprising:

a housing having a longitudinal bore disposed therein, a transverse bore disposed in a wall thereof and communicating with an outer surface of said housing, and a longitudinal slot means disposed in said longitudinal bore for communicating said longitudinal bore with said transverse bore; and a valve member received in said transverse bore and adapted for movement between an open position wherein said longitudinal bore is communicated with said outer surface through said transverse bore, and a closed position wherein said longitudinal bore is isolated from said outer surface.

24. The apparatus of claim 23, wherein:

said slot intersects said transverse bore.

25. The apparatus of claim 23, wherein:

said slot is disposed in a radially inward projecting annular ledge of said housing so that said slot communicates an upper enlarged inner diameter portion of said longitudinal bore located above said ledge with a lower enlarged inner diameter portion of said longitudinal bore located below said ledge.

26. A method of opening a circulation valve in a well, said circulation valve being of the type having a valve mandrel slidably disposed in a cylindrical housing and movable from a closed position closing a circulating port disposed through said housing to an open position opening said circulating port, said method comprising the steps of:

biasing said valve mandrel toward said open position by means of a compression spring arranged to move said valve mandrel to said open position upon extension of said compression spring;

initially retaining said valve mandrel in said closed position by means of shear pin means connected between said valve mandrel and said housing;

increasing pressure exterior of said housing to move a power mandrel in a first direction within said cylindrical housing, said pressure exterior of said housing being communicated to an annular piston of said power mandrel through a power port disposed through a wall of said cylindrical housing;

engaging said sliding valve mandrel with said power mandrel upon movement of said power mandrel in said first direction;

shearing said shear pin means to release said valve mandrel; and moving said valve mandrel in said first direction to its said open position.

* * * * *